US009795526B2

(12) United States Patent
Davis

(10) Patent No.: US 9,795,526 B2
(45) Date of Patent: Oct. 24, 2017

(54) PROTECTIVE COVER FOR WHEELCHAIR USER

(71) Applicant: Brenda Fay Davis, Hampton, VA (US)

(72) Inventor: Brenda Fay Davis, Hampton, VA (US)

(73) Assignee: Brenda Fay Davis, Hampton, VA (US)

( * ) Notice: Subject to any disclaimer, the term of this patent is extended or adjusted under 35 U.S.C. 154(b) by 0 days.

(21) Appl. No.: 14/843,942

(22) Filed: Sep. 2, 2015

(65) Prior Publication Data

US 2016/0058638 A1 Mar. 3, 2016

Related U.S. Application Data

(60) Provisional application No. 61/998,021, filed on Sep. 2, 2014.

(51) Int. Cl.
*A61G 5/10* (2006.01)
*A47C 7/66* (2006.01)

(52) U.S. Cl.
CPC . *A61G 5/10* (2013.01); *A47C 7/66* (2013.01)

(58) Field of Classification Search
CPC ..... A61G 5/10; A47C 7/66; A47C 1/14
USPC ..... 297/184.1, 184.11, 184.14, 184.15; 135/121, 157, 96
See application file for complete search history.

(56) References Cited

U.S. PATENT DOCUMENTS

| | | | | |
|---|---|---|---|---|
| 1,438,667 | A * | 12/1922 | Schops | A47C 3/02 297/184.15 |
| 3,034,523 | A * | 5/1962 | De Shano | E04H 15/48 135/128 |
| 4,389,057 | A * | 6/1983 | Richard, Jr. | A61G 5/10 135/90 |
| 4,609,175 | A | 9/1986 | Conover | |
| 4,788,997 | A * | 12/1988 | Clopton | E04H 15/001 135/117 |
| 5,634,650 | A | 6/1997 | Hensler, Sr. et al. | |
| 5,791,761 | A | 8/1998 | Bryant et al. | |
| 6,378,539 | B1 | 4/2002 | Allee | |
| 7,493,908 | B2 | 2/2009 | Carter et al. | |
| 7,690,389 | B2 | 4/2010 | Barreiro | |
| 2008/0023052 | A1 | 1/2008 | Barreiro | |
| 2010/0193262 | A1* | 8/2010 | Zhao | A61G 5/045 180/2.2 |

FOREIGN PATENT DOCUMENTS

| | | | | |
|---|---|---|---|---|
| DE | 3131166 | A1 * | 2/1983 | A47C 7/66 |

* cited by examiner

*Primary Examiner* — Milton Nelson, Jr.
(74) *Attorney, Agent, or Firm* — Jingfeng Song

(57) ABSTRACT

This invention describes a protective cover for a wheelchair user, which comprises a frame structure, a fabric hood, and a curtain. The frame structure is attached to the body or handles of a wheelchair and hangs over the user sitting in the wheelchair. The fabric hood is waterproof and covers the top of the frame structure. A curtain made of transparent plastics or mesh screen is attached to the fabric hood or the frame structure and hangs down from the top in all directions to enclose the wheelchair user to near ground level and protect the user from rain, wind, bugs, sun, or other undesired outdoor conditions.

10 Claims, 2 Drawing Sheets

PROTECTIVE COVER FOR WHEELCHAIR USER

BACKGROUND OF THE INVENTION

Wheelchair users need to go for outdoor activities in their daily life. Umbrellas are usually brought with them to avoid getting wet under the inclement weather. However, without another person's help it is extremely inconvenient, if not impossible, for a user to open and hold an umbrella while pushing the wheelchair.

Several patents have discussed how to attach an umbrella to a wheelchair so that the wheelchair user's hands are free for tasks other than holding the umbrella. For instance, U.S. Pat. No. 4,609,175 describes an umbrella holder that is supported by both thighs of a wheelchair user. When it is in use, a user is able to put the shaft of an open umbrella into the holder and use his hands to push the wheelchair. U.S. Pat. No. 5,634,650 shows a mechanism for an umbrella to be mounted on the frame of a wheelchair. Inventors in U.S. Pat. Nos. 5,791,761, 6,378,539, and 7,690,389 disclose different ways of holding an umbrella to a wheelchair by either installing a holder to the wheelchair or modifying the shaft structure of the umbrella. However, umbrellas showed in these inventions are not an enclosing system so that it can protect only part of a wheelchair user's body from rain or wind. None of them is able to cover the user's body from the top to the bottom when he sits on the wheelchair. As an open system, these umbrellas are unable to prevent bugs from interfering wheelchair users in an outdoor environment.

It is therefore an objective of this invention to provide a protective cover that is distinct from umbrellas described in the preceding paragraph and can be attached to a wheelchair. It is a further objective of this invention to prepare a cover that is used to protect a wheelchair user's body from undesired outdoor conditions such as rain, wind, bugs, or sun, yet does not prevent the user or attendant from pushing the wheelchair.

SUMMARY OF THE INVENTION

A wheelchair user needs to be protected from undesired outdoor conditions such as rain, wind, or sun. However, umbrellas described in references only cover the upper body of a wheelchair user. They are unable to provide a comprehensive coverage for the user's body. In addition, these umbrellas can't protect the user from outdoor bugs like mosquitoes. The objective of the current invention is to prepare a protective cover that can provide a substantial coverage for a user sitting on the wheelchair so that the user is protected from undesired outdoor conditions. The cover needs to be conveniently attached to and detached from a wheelchair.

In accordance with the invention, the objective is fulfilled by preparing a cover that comprises a frame structure attaching to and hanging over the wheelchair, a fabric hood covering the top of the frame structure, and a curtain hanging down from the frame structure or fabric hood and enclosing a sitting user's body from the top to near ground level. While sitting on the wheelchair installed with this inventive cover, a user is able to stay away from those undesired outdoor conditions and push the wheelchair in a way that is not affected by the cover.

The size of the frame structure, the fabric hood, and the curtain may vary so long as the protective cover is able to provide a comprehensive coverage to a wheelchair user, yet does not detrimentally affect the way how the user or attendant pushes the wheelchair.

In some embodiments of the invention, the cover has a double rectangular frame hanging over the wheelchair.

In particular embodiments of the invention, the double rectangular frame is formed with Polyvinyl Chloride (PVC) pipes that are connected with each other through PVC fittings.

In more particular embodiments of the invention, the curtain hooked to the double rectangular frame is made of transparent plastics.

In other more particular embodiments of the invention, the curtain hooked to the double rectangular frame is made of fine mesh screen.

In some other embodiments of the invention, the cover has a single rectangular frame hanging over the wheelchair.

In particular embodiments of the invention, the single rectangular frame comprises PVC pipes that are connected with each other and the wheelchair handles through PVC fittings.

In more particular embodiments of the invention, the curtain is bound to the fabric hood through adhesive fastener.

DETAILED DESCRIPTION OF THE PREFERRED EMBODIMENTS

Current invention relates to a protective cover, which hangs over a wheelchair and protects a user from undesired outdoor conditions. The cover comprises a frame structure attached to the wheelchair, a fabric hood covering the top of the frame structure, and a curtain that is attached to the top of frame structure or the fabric hood and hangs down to enclose the wheelchair user's body from the top to near ground level.

In order to keep its weight light the frame structure is formed with pipes. These pipes are made of metal, preferably polymeric materials, or more preferably PVC. Pipes are connected with each other through pipe connectors which are made of either polymeric or metal materials. PVC fittings are preferred as the connectors when PVC pipes are used. Metal pipes can also be connected with each other by welding to form the frame structure. Although the shape of the frame structure can be circular, oval, triangular, square, etc., it is preferred to be rectangular. The frame structure comprises a single rectangular frame, a double rectangular frame, or combination of different types of frames. The frame structure hangs over the wheelchair and stays substantially parallel to the seat of a wheelchair with the support of upright pipes bound to the wheelchair handles or other portions of the wheelchair body. The wheelchair seat is horizontal and mostly parallel to the ground level. Being substantially parallel to the seat means that the angle formed between the horizontal level of the rectangular frame and the seat is not more than 10°.

The fabric hood is placed on the top of the frame structure. It is used to block the rain or sun from reaching the wheelchair user from the top. Therefore, it is preferred to be water proof and opaque. However, a plastic hood may replace the fabric hood when it is used only for rain protection. It is desired that the edge of the fabric hood is able to be attached with adhesive fastener, zipper, or hooks so that a curtain can be bound to the hood.

The curtain is attached to the upper parts of the protective cover, which includes the top of the frame structure and the fabric hood. The means of attachment includes fastening, zipping, or hooking the curtain to the upper parts of the protective cover. The curtain can not be opaque so that a user sitting inside the cover is able to see the surrounding area while pushing the wheelchair. The curtain is preferably made of water proof materials such as clear plastics so that it can be used under the raining condition. It can also be made of fine mesh screen for preventing bugs from getting into the cover yet keeping the fresh air flowing. The curtain comprises either one or more pieces of sheets, which are made of materials described above, so long as it is able to enclose the user sitting on the wheelchair and protect him from those undesired outdoor conditions.

Figure 1:
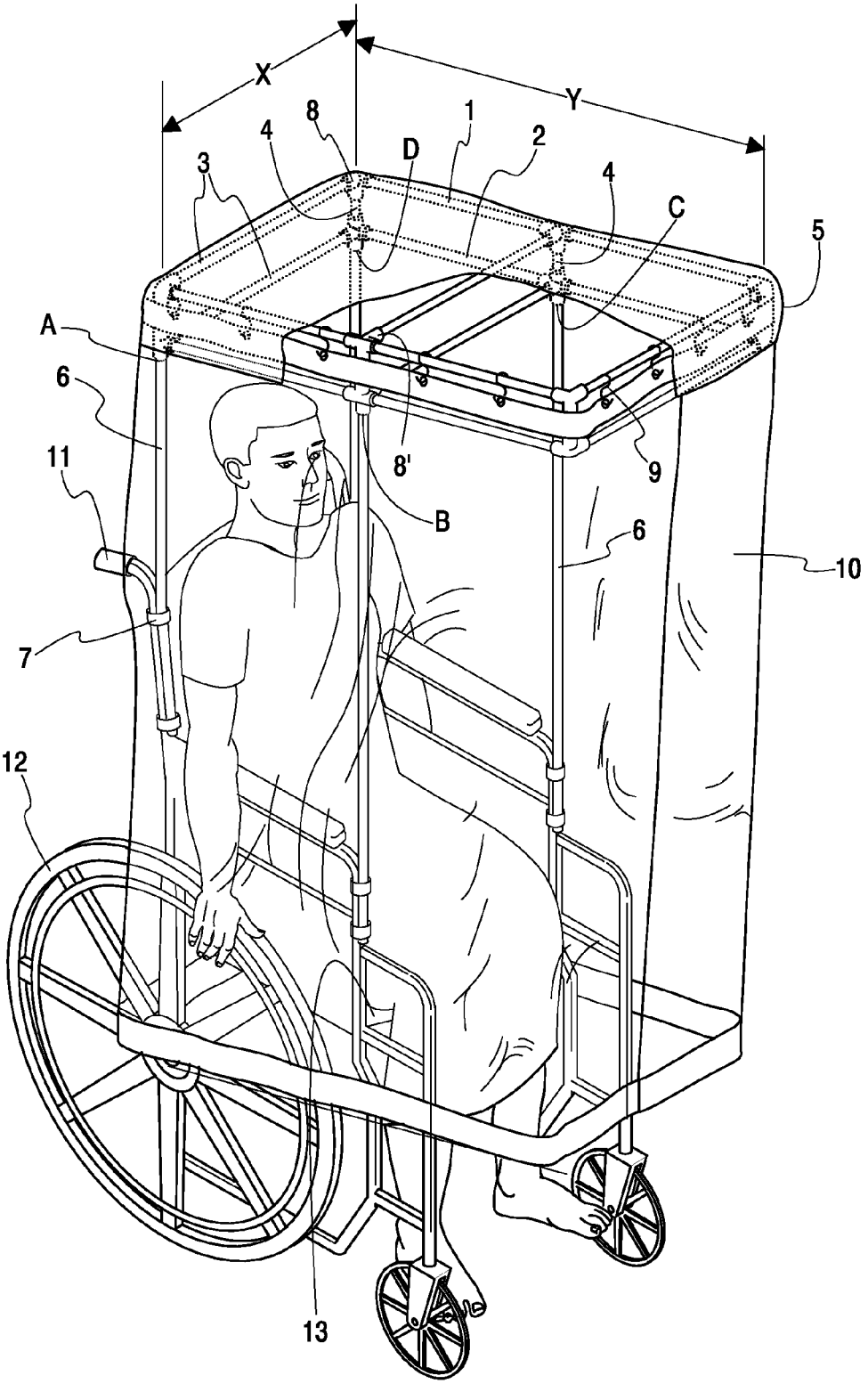
FIG. 1 shows a protective cover with a double rectangular frame, a fabric hood, and a curtain that is hooked to the frame and encloses a sitting wheelchair user from the top to near ground level.

One preferred embodiment of the current invention is shown in FIG. 1. A protective cover is installed on a wheelchair 12 with a horizontal seat that is parallel to the ground level. In this figure, a double rectangular frame 3 is seen to hang over the wheelchair. The frame comprises an upper rectangular frame 1 and a lower rectangular frame 2. Both frames are identical in size and formed with pipes. Each of them has two short sides X and two long sides Y. The length of the short sides is about the same as the distance between the two handles 11 of the wheelchair. Each of the long sides is formed with two pipes. An additional pipe, which has the same length as the short side, is placed within the rectangular frame and connects both long sides together. There are total six vertices in each rectangular frame. Six upright pipes 4 are used to connect the upper and lower frames together through six vertices in both frames. All pipes are connected with each other through PVC fittings 8 & 8', which include three-way, four-way, and five-way joint connectors, to form the double rectangular frame. One end of four parallel pipes 6 is bound to portions of the wheelchair by circular clamps 7. The other end of these parallel pipes is connected to the double rectangular frame through PVC fittings at four vertices A, B, C, and D. The horizontal level of four parallel pipes 6 can be adjusted by loosening clamps and moving them up and down so that the horizontal level of the double rectangular frame is substantially parallel to the wheelchair seat 13. In other embodiments, these parallel pipes can be bound to the wheelchair by inserting them to the tubes attached to the wheelchair by clamps.

The way how the fabric hood 5 covers the double rectangular frame can be seen through the sectional view in FIG. 1. The hood covers not only the top but also all four sides of the double frame. In other embodiments, a fabric flap is attached to the hood and can be flipped down to cover part of the curtain for sun protection. It is also shown in the sectional view that a transparent curtain 10 with hanging holes is attached to the upper rectangular frame with S-shaped hooks 9. The curtain hangs down from the top in all directions and covers the user sitting on the wheelchair to near ground level. It is also demonstrated in FIG. 1 that the user is free to use his hands to push the wheelchair even though he is enclosed by the curtain. The curtain may be separated into two or more pieces of sheets so that the user can walk in and out of the protective cover.

Figure 2:
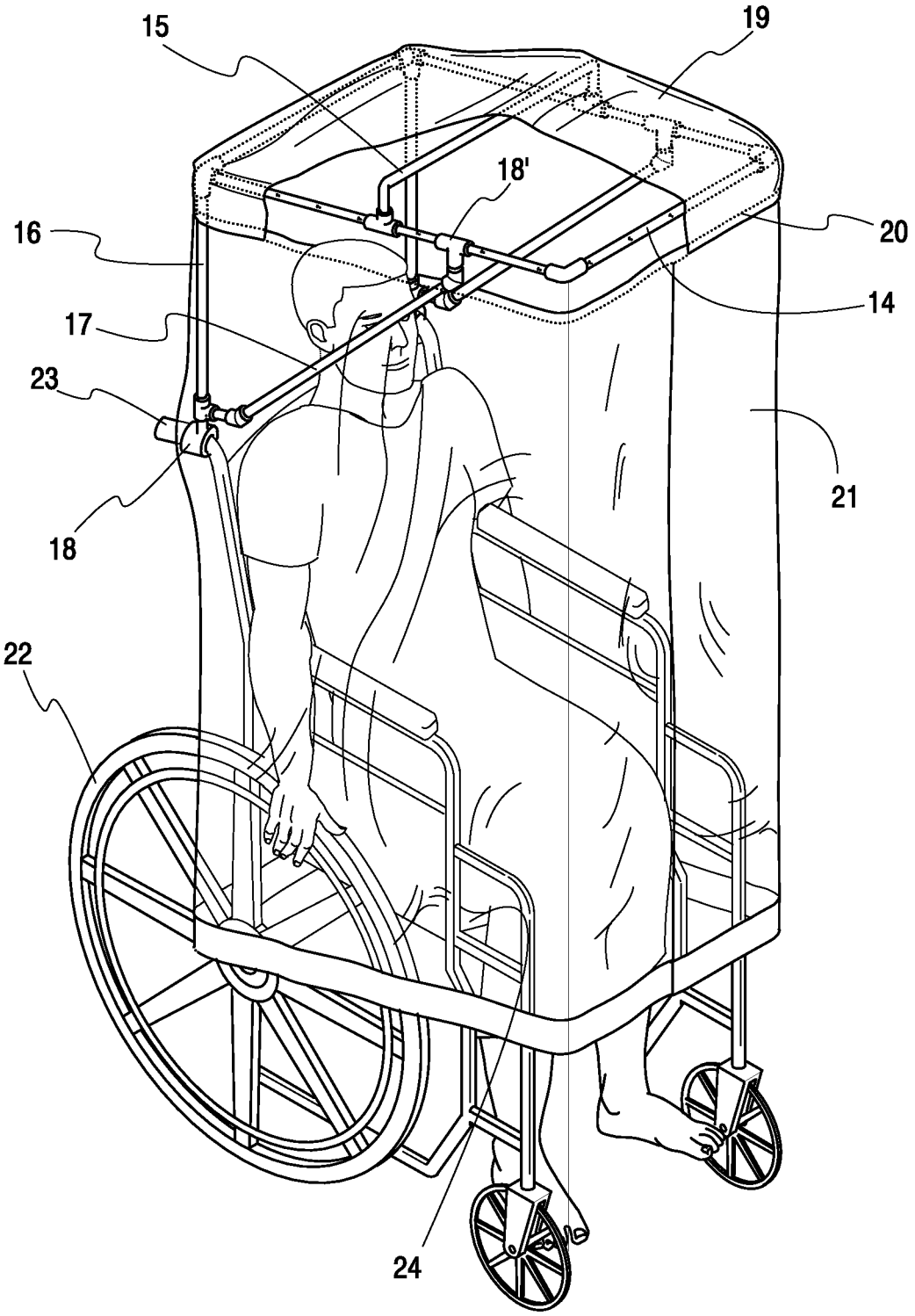
FIG. 2 shows a protective cover with a rectangular frame, a fabric hood, and a curtain that is bound to the fabric hood via adhesive fastener and encloses a sitting wheelchair user from the top to near ground level.

Another preferred embodiment of the current invention is depicted in FIG. 2. A single rectangular frame 14 has two short sides and two long sides. The length of both short sides is about the same as the distance between two handles 23 of the wheelchair 22. The rectangular frame 14 is substantially parallel to the wheelchair seat 24. An "n" shaped pipe 15 connects both long sides of the frame. The rectangular frame hangs over the wheelchair and is supported by two upright pipes 16, which are attached to the wheelchair handles. The rectangular frame is also supported by two skew pipes 17. Each of these skew pipes connects together the upright pipe and the long side of the rectangular frame. The horizontal level of the rectangular frame is substantially parallel to the seat of the wheelchair. All of pipes described above are connected with each other and the wheelchair handles through PVC fittings 18, 18'.

The sectional view of FIG. 2 shows the fabric hood 19 and the way how it covers the rectangular frame. In addition, a strap of adhesive fastener 20 such as Velcro is attached on both the fabric hood and the curtain 21 so that they are able to be bound together through the fastener strap. The curtain hangs down from the fabric hood in all direction and encloses the user to near the ground level. The curtain in this embodiment is made of transparent plastic materials. In other embodiments, the curtain can be made of fine mesh screen.

Pipes used in both embodiments described in FIGS. 1 and 2 are made of PVC materials. It is to be understood that the above description and drawings are only used to illustrate some of the most preferred embodiments of the current invention. They are not intended to limit the scope of the present invention. Any variation from the description and drawings such as the size and shape of the frame structure, the material and size of those pipes, the fabric hood, and the curtain, and different ways of how the curtain is attached to the top of the protective cover is encompassed by the scope of the current invention.

What is claimed is:

1. A protective cover for attachment to a wheelchair with a horizontal seat and two handles comprising:

a double rectangular frame having lower and upper rectangular frames that are formed with pipes, the upper frame being on top of the lower frame with at least four upright pipes sitting between the upper and lower frames and connecting both frames together;

at least four parallel pipes standing upright with one end of each pipe connecting to one of those upright pipes and the other end used for attaching the double rectangular frame to the wheelchair;

a fabric hood covering the top and four sides of the double rectangular frame; and a curtain attaching to the fabric hood or double rectangular frame and hanging down in all directions to enclose a user when sitting on the wheelchair seat from the top to near ground level.

2. A cover as described in claim 1, wherein the upright and parallel pipes comprise metal or polymeric materials.

3. A cover as described in claim 2, wherein the upright and parallel pipes comprises Polyvinyl Chloride.

4. A cover as described in claim 3, wherein the upright and parallel pipes are connected with each other through Polyvinyl Chloride fittings.

5. A cover as described in claim 3, wherein stainless steel clamps are attached to said four parallel pipes.

6. A cover as described in claim 1, wherein the fabric hood comprises water-proof materials.

7. A cover as described in claim 1, wherein the curtain comprises mesh screen.

8. A cover as described in claim 1, wherein the curtain comprises transparent plastics.

9. A cover as described in claim 1, wherein the curtain is attached to the fabric hood through adhesive fastener, hooks, or zipper.

10. A cover as described in claim 1, wherein the curtain is attached to the double rectangular frame by hooks.

* * * * *